United States Patent [19]

Martonfi, Sr.

[11] 4,338,915

[45] Jul. 13, 1982

[54] STOVE CONSTRUCTION

[76] Inventor: Joseph Martonfi, Sr., 500 Rang St. Francois, Blainville, Quebec, Canada

[21] Appl. No.: 238,586

[22] Filed: Feb. 26, 1981

[30] Foreign Application Priority Data

Dec. 15, 1980 [CA] Canada ..... 366772

[51] Int. Cl.[3] ..... F23H 1/02

[52] U.S. Cl. ..... 126/163 A; 126/77; 126/146; 126/151

[58] Field of Search ..... 126/242, 245, 243, 163 R, 126/163 A, 152 R, 152 A, 152 B, 111, 2, 55, 12, 58, 77, 146, 147, 151, 144, 193, 15 R, 15 A

[56] References Cited

U.S. PATENT DOCUMENTS

| | | | |
|---|---|---|---|
| Re. 121 | 7/1848 | Morse | 126/163 A |
| 462,804 | 11/1891 | Selleck | 126/111 |
| 498,826 | 6/1893 | Tilden | 126/111 |
| 1,129,134 | 2/1915 | Stark | 126/163 A |
| 1,179,245 | 4/1916 | Walters | 126/163 A |
| 1,310,327 | 7/1919 | Dutton | 126/163 A |
| 1,465,442 | 8/1923 | Jones | 126/163 A |
| 1,639,642 | 8/1927 | Law | 126/163 A |
| 1,674,304 | 6/1928 | Schamberg | 126/163 A |
| 1,977,951 | 10/1934 | O'Brien | 126/147 |
| 2,346,586 | 4/1944 | Keown | 126/163 A |

FOREIGN PATENT DOCUMENTS

| | | |
|---|---|---|
| 261969 | 12/1926 | United Kingdom . |
| 595869 | 12/1947 | United Kingdom . |
| 952582 | 3/1964 | United Kingdom . |
| 1180521 | 2/1970 | United Kingdom . |
| 1466210 | 3/1977 | United Kingdom . |
| 1568596 | 6/1980 | United Kingdom . |

*Primary Examiner*—Daniel J. O'Connor
*Attorney, Agent, or Firm*—Colton & Stone, Inc.

[57] ABSTRACT

The invention relates to a stove which burns a primary combustible material in a container placed on a horizontal plate which divides the stove into upper and lower combustion chambers. The plate has a central aperture therethrough which, in operation, is in registry with a central opening in the container bottom wall. A hollow perforated tube is positioned in the container in registry with the opening and the aperture and the combustible material fills the container, surrounding the wall of the tube. When a temporary starting fire is lit in the lower chamber, the flames thereof will be drawn up into the tube and will light the combustible material in the container through the perforations in the tube. The combustible material in the container will burn radially outwardly from the tube in a uniform manner, with air circulation being provided in the expanding annular space between the tube and the burning face of the combustible material. Combustion may be controlled via appropriate air vents and ash will accumulate in the bottom of the container. The container may be removed so that the ashes may be conveniently disposed of and so that the container may be recharged with new combustible material.

8 Claims, 4 Drawing Figures

STOVE CONSTRUCTION

This invention relates to stoves in general and in particular to a new stove adapted to contain controlled combustion within a removable container placed, in operation, within the stove.

BACKGROUND OF THE INVENTION

With problems created by continuously depleting oil and natural gas supplies many people are returning to wood stoves for use as secondary, or even primary, sources of heat for their houses. There have been many developments in the wood stove art of late, perhaps the most significant being the air-tight stove which greatly prolongs the combustion time of the combustible material, usually wood, while providing an optimum amount of heat. Such stoves represent a considerable improvement, but still have certain drawbacks. In particular it is still necessary to directly stoke the combustion chamber, or fire box, with wood or other material and to empty the stove of ashes when combustion has ceased. Also, while combustion times have increased they have not as yet reached their optimum or maximum extents.

SUMMARY OF THE INVENTION

The present invention addresses the problems evidenced by prior art wood stoves, including the latest generation of air-tight stoves. The present invention utilizes a removable container which can be precharged with combustible material prior to insertion into the stove, thereby permitting a user owning two such containers to have one charged container ready for insertion into the stove once the combustible material in the container in use has been consumed. Ashes are retained in the container as the material burns and can be easily emptied after removal of the exhausted conainer. In use the container is placed in an upper chamber of the stove separated from a lower chamber by a plate on which the container rests. The container has a bottom opening which registers with an aperture in the plate and is also provided with a perforated tube extending upwardly from the bottom wall thereof above the opening in the bottom wall. The combustible material fills the container, surrounding the tube. A temporary, starting fire is ignited in the lower chamber and the flames thereof are drawn upwardly through the aperture and opening into the tube so that they ignite the material in the container through the perforations in the tube. The material in the container burns radially outwardly from the tube, creating an annular space between the tube and the burning face of the material. Ash slides down the burning face to accumulate on the bottom wall of the container. There is sufficient air circulation created in the annular space to ensure controlled slow combustion of the material in the container. The rate of combustion may be controlled by way of an adjustable vent which can be appropriately moved to control the draft within the upper combustion chamber.

The stove of the present invention may use any of the commonly available combustible materials such as wood, coal or charcoal briquettes. The rate of combustion is improved (i.e. made slower), however, if there is little or no opportunity for flame propagation within the combustible material, as would be provided along the air passageways created between adjacent pieces of the above-suggested materials. To improve the rate of combustion it is suggested that a mixture of at least sawdust and coal dust be used, which mixture may be pressed into a compact form within the container and surrounds the perforated tube. Such a mixture would be consumed at a comparably slow rate while giving off more than enough heat during combustion to satisfy most individuals.

In summary, therefore, the present invention may be broadly defined as providing for use in a stove having upper and lower chambers separated by an apertured horizontal member, the lower chamber being adapted to contain a temporary starting fire, the improvement which comprises: container means positionable in the upper chamber on the horizontal member and having an opening in a bottom wall thereof registrable with the aperture in the horizontal member; and perforated flame propagation means positionable in the container means and extending upwardly from the opening; the container means being adapted to receive combustible material in a space defined between the flame propagation means and side walls of the container means.

Furthermore the present invention may be seen as providing a stove for burning combustible material comprising: a housing; means for extracting flue gases from the housing; a horizontal member dividing the interior of the housing into an upper chamber and a lower chamber, the member having a generally central aperture therethrough; upper and lower openable door means in a side wall of the housing for permitting access to the upper and lower chambers respectively; the lower chamber being adapted to contain a starting fire therein below the aperture; container means in the upper chamber and having side walls and a bottom wall, the bottom wall having a generally central opening therethrough, with the opening in registry with the aperture; and flame propagation means positionable in the container means and extending upwardly from the bottom wall, the flame propagation means comprising a generally elongated tube positionable in registry with the opening and having a plurality of holes extending through the tube wall; whereby, with combustible material substantially filling the container means and surrounding the flame propagation means, and with the container means enclosed in the upper chamber, flames from a small temporary starting fire in the lower chamber will be drawn upwardly through the aperture and the opening into the flame propagation means and will pass through the holes to initiate combustion of the combustible material in the container means, combustion of the material continuing generally radially outwardly of the flame propagation means.

DESCRIPTION OF THE PREFERRED EMBODIMENT

Figure 1:
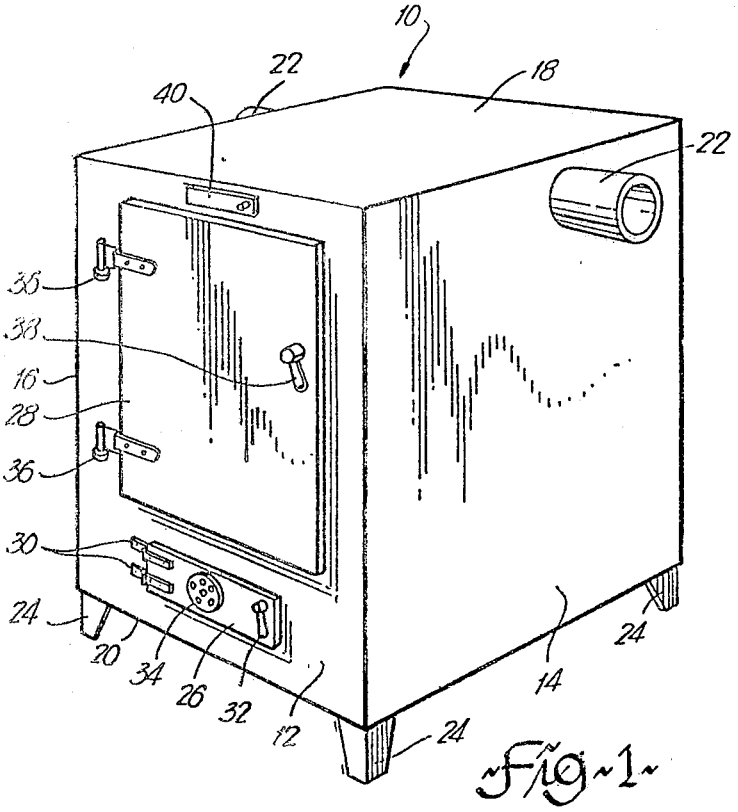
FIG. 1 is a perspective view of the stove of the present invention in its operative mode.

FIG. 1 shows the front view of a stove 10 embodying the present invention. As can be readily seen the stove forms a housing having a front wall 12, side walls 14, 16, a top wall 18 having optional overhanging edge portions, a bottom wall 20, and a back wall (not shown). Extending outwardly from each of the side walls, subjacent the top wall, are pipe sections 22 communicating to the interior of the stove and adapted to be connected to a chimney for passing flue gases to the atmosphere. The stove is elevated above the floor by feet 24 positioned at each corner of the bottom 20. The height of the feet will of course be in conformance with any applicable building codes.

Hinged to the front wall 12 are two doors 26 and 28. Door 26 is the smaller of the two and is located adjacent the bottom wall 20. The door is hinged to the front wall as by hinges 30 and is provided with a rotatable handle 32 which, on the back side of the door, is connected to a latch so that the door may be latched into a closed position. Also provided on the face of the door is a rotatable vent 34 having apertures registrable with apertures in the door itself to provide an inlet for air into the lower portion of the stove. This type of door is quite common in wood stoves.

Door 28 is considerably larger than door 26 and covers a substantial portion of the front wall 12 above the door 26. Door 28 is removably hinged to the front wall 12 in a conventional manner as by gate-type hinges 36. A handle 38 is also provided, cooperating with a latch on the back side of the door for latching the door in a closed position. If desired the handle may be provided with conventional locking means for locking the floor in the closed position. Furthermore, the periphery of the opening in the front wall 12 is provided with appropriate sealing means so that the door is tightly sealed to the opening when it is closed. Such a sealing means is conventional in the art and need not be described in detail herein.

Above the door 28, a slidable plate 40 is mounted in a cooperating opening in the front wall. Plate 40 can be used to control the amount of air admitted to the upper portion of the stove so as to control the rate of combustion of the primary combustible material within the stove.

Figure 2:
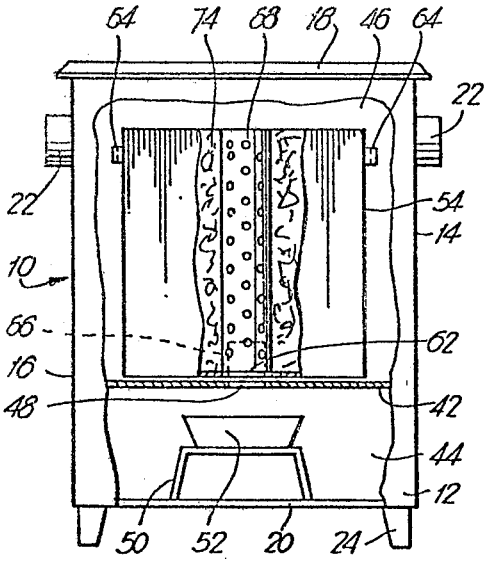
FIG. 2 is a front view, with a portion of the front wall and doors cut away to reveal the interior and with a portion of the container therein cut away to reveal its interior.

Internally as shown in FIG. 2, the stove is provided with a horizontal plate 42 which divides the interior into a lower chamber 44 and an upper chamber 46, the upper chamber being of considerably greater volume than the lower chamber. Plate 42 is provided with a central aperture 48 therethrough of relatively small diameter in relation to the area of the plate. With the exception of aperture 48, the plate completely fills the horizontal area of the stove interior. It may be welded to the stove walls or it may be provided with feet (not shown) which support it at the desired distance above the upper surface of the bottom wall 20. Within the lower chamber 44 is provided a stand 50 which supports a removable pan 52 in which secondary combustible material, such as ordinary starting fluid, may be positioned. Pan 52 could be replaced by a small grate (not shown) if the secondary combustible material is to be wood shavings, twigs, paper or the like.

Figure 3:
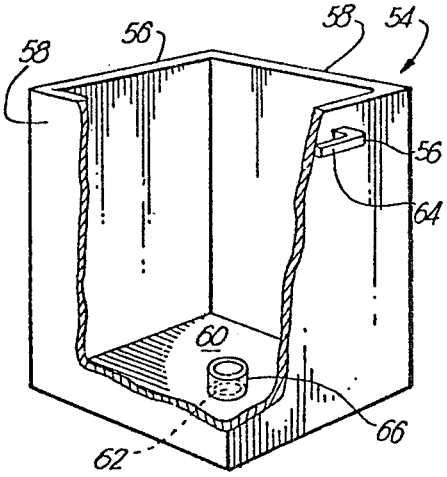
FIG. 3 is a perspective view, partially cut away, of the container used in the stove of the present invention.

The horizontal plate 42 is formed of hot-rolled steel plate as are the other components of the stove, the material being selected for its strength and heat radiating properties. Plate 42 must be capable of supporting a reasonably heavy load as it is adapted to support a rectangular container 54 thereon. Container 54 is intended to contain the primary combustible material and, as seen more completely in FIG. 3, it includes side walls 56, front and rear walls 58, and bottom wall 60. Bottom wall 60 is provided with a central opening 62 which, when the container 54 is positioned in the stove on the plate 42, will be in registry with the aperture 48 in that plate. Container 54 is also provided with carrying handles 64 on the sides thereof and a removable top cover (not shown) is also provided.

Figure 4:
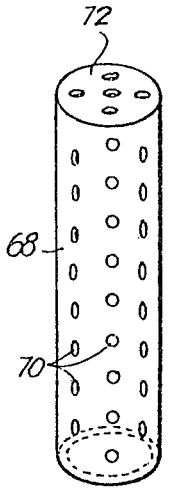
FIG. 4 is a perspective view of the perforated tube positionable in the container.

On the upper surface of the bottom wall 60 the container is provided with an annular flange 66 which extends upwardly for a short distance and surrounds the opening 62. The flange 66 in turn centers and supports a flame propagating element 68 which as shown in FIGS. 2 and 4 is in the shape of a cylindrical tube. Extending through the wall of the tube over its entire length and circumference is a plurality of holes or perforations 70. The bottom of the perforated tube 68 is open for reception of the flange 66 while the top is provided with a perforated plate 72.

In operation, the container 54 is first of all charged with primary combustible material, (74 in FIG. 2) externally of the stove, and with the flame propagating tube 68 in position on flange 66. While any type of combustible material may be used, such as wood, coal, charcoal briquettes and the like the preferred material is a compressed mixture of sawdust, coal dust and other small pieces of combustible material such as wood chips or coal pieces. Such a mixture could be prepared at home at very little expense and has the advantage of providing little or no passage therethrough for flame or air whereby a slow rate of combustion, combined with high heat output is achieved.

The charged container is then positioned in the upper chamber 46 of the stove through the opening defined by the open door 28 and it is positioned on the plate 42 with the opening 62 in registry with the aperture 48 as shown in FIG. 2. Since the tube 68 is already within the charged container an air space exists therein which is in communication via the opening 62 and the aperture 48 with the lower chamber 44. The door 28 is then closed and the sliding plate 40 is placed in the closed position.

A starting fire is then set in the lower chamber 44 as by lighting starting fluid with the pan 50 or by setting a small fire on a grate within the lower chamber. Door 26 is then closed and combustion of the secondary material in the lower chamber is controlled by the vent 34.

As the starting fire burns, the flames produced thereby will be drawn up into the flame propagating tube 68 by the draft created in the stove. The flames of the starting fire will ignite the primary combustible material within the container via the holes 70 and combustion of the primary material will continue radially outwardly of the tube 68 after the starting fire has died out. As the primary material burns, ash will slide down the burning face thereof to collect in the base of the container and the increasing diameter space between the tube 68 and the burning face will ensure that there is sufficient air circulation to maintain combustion. Combustion will continue until all of the material in the container 54 is consumed, the rate of combustion being controlled by the position of the sliding plate 40. If the plate is moved so as to admit more air to the upper chamber the rate of combustion, and hence the heat delivered, will increase, and vice versa. With a mixture as described above it is contemplated that combustion could be maintained for upwards of twenty-four hours. With more loosely packed material, such as wood or coal the time elapsed until all of the material is consumed would be less.

Once the material has been consumed and the stove has cooled down, the container can be removed for emptying the ash which has accumulated in the bottom. The cover is positioned on top of the container before removal so as to avoid any dust or embers from inadvertently exitting the container. In order to keep ash from exitting the opening 62 via the lower holes in the tube 68 it is desirable that the flange 66 extend upwardly above the expected maximum height of ash within the container so as to block the lower holes in the tube 68. Alternatively the holes could commence at a distance spaced from the lower end of the tube 68 at least equal to the expected maximum height of the ash.

If it is desired to maintain heat over an extended period of time it would be possible to remove the container from the stove before it has cooled down. It would be necessary to place the still-hot container on a heat insulating material such as an asbestos pad and it would be necessary for the operator to use heat insulating gloves when grasping the handles 64. A second container 54, precharged with the primary combustible material could then be positioned in the stove and the combustion cycle could then be repeated with this precharged second container.

While the best mode contemplated to date of putting the present invention into effect has been described hereinabove it is understood that variations to the structure and principle of operation could occur to a skilled person in the art. Accordingly, the protection to be afforded this invention is to be determined from the claims appended hereto.

The embodiments of the invention in which an exclusive property or privilege is claimed are defined as follows:

1. A stove for burning combustible material comprising:

a housing;

means for extracting flue gases from said housing;

a horizontal member dividing the interior of said housing into an upper chamber and a lower chamber, said member having a generally central aperture therethrough, upper and lower openable door means in a side wall of said housing for permitting access to said upper and lower chambers respectively;

said lower chamber being adapted to contain a starting fire therein below said aperture;

container means in said upper chamber and having side walls and a bottom wall, said bottom wall having a generally central opening therethrough, with said opening in registry with said aperture; and flame propagation means positionable in said container means, and extending upwardly from said bottom wall, said flame propagation means comprising a generally elongated tube positionable in registry with said opening and having a plurality of holes extending through the tube wall;

whereby, with combustible material substantially filling said container means and surrounding said flame propagation means, and with said container means enclosed in said upper chamber, flames from a small temporary starting fire in said lower chamber will be drawn upwardly through said aperture and said opening into said flame propagation means and will pass through said holes to initiate combustion of the combustible material in said container means, combustion of said material containuing generally radially outwardly of said flame propagation means.

2. The stove as claimed in claim 1 wherein said container means is removably positionable in said upper chamber on said horizontal member.

3. The stove as claimed in claim 2 and including means for containing the starting fire within said lower chamber.

4. The stove as claimed in claim 3 wherein said containing means includes a stand positioned on a bottom wall of said lower chamber and a pan for containing a starting fluid, positionable on said stand below said aperture in said horizontal member.

5. The stove as claimed in claim 2 and including first adjustable air vent means in said lower door means for controlling admission of air to said lower chamber.

6. The stove as claimed in claim 2 or claim 5 and including second adjustable air vent means in said housing side wall for controlling admission of air to said upper chamber.

7. The stove as claimed in claim 2 and including a flange extending upwardly from the bottom wall of said container means and surrounding said opening therein for supporting said flame propagation means thereon.

8. The stove as defined in claim 2 or claim 7 wherein said flame propagation means is of essentially the same height as the interior of said container means and is provided with a perforated top plate at the upper end thereof.

* * * * *